US010221852B2

(12) United States Patent
Shaffer et al.

(10) Patent No.: US 10,221,852 B2
(45) Date of Patent: Mar. 5, 2019

(54) MULTI STAGE SCROLL VACUUM PUMPS AND RELATED SCROLL DEVICES

(71) Applicant: Air Squared, Inc., Broomfield, CO (US)

(72) Inventors: Robert W. Shaffer, Broomfield, CO (US); Bryce R. Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 0 days.

(21) Appl. No.: 14/999,427

(22) Filed: May 4, 2016

(65) Prior Publication Data

US 2016/0327042 A1 Nov. 10, 2016

Related U.S. Application Data

(63) Continuation-in-part of application No. 14/544,874, filed on Feb. 27, 2015, now Pat. No. 9,885,358, which (Continued)

(51) Int. Cl.
*F04C 18/02* (2006.01)
*F04C 29/00* (2006.01)
(Continued)

(52) U.S. Cl.
CPC ..... *F04C 23/001* (2013.01); *F04C 18/0215* (2013.01); *F04C 18/0223* (2013.01);
(Continued)

(58) Field of Classification Search
CPC .. F04C 18/023; F04C 29/0057; F04C 29/007; F04C 23/001
(Continued)

(56) References Cited

U.S. PATENT DOCUMENTS 3,011,694 A 12/1961 Audemar
3,802,809 A 4/1974 Vulliez
(Continued)

FOREIGN PATENT DOCUMENTS

JP 57171002 A * 10/1982 ..... F01C 1/0223

*Primary Examiner* — Mark Laurenzi
*Assistant Examiner* — Deming Wan
(74) *Attorney, Agent, or Firm* — Sheridan Ross P.C.

(57) ABSTRACT

A multi-stage vacuum pump, expander, or compressor, that incorporates one or more stages of a fixed scroll(s) and orbiting scroll(s) that operates simultaneously. The motor drives the orbiting scroll(s) within the structure, and the various fixed and orbiting scrolls are arranged for either parallel generation of a vacuum or high pressure gas, or arranged in series for generating of a significantly high vacuum or gaseous pressure, or a combination of parallel arranged and series arranged fixed and orbiting scrolls may be embodied within the structure, operated by a single motor means, in order to attain the high efficiencies of operation as a vacuum pump, or a gaseous compressor, during its functioning. The various combinations of orbiting and fixed scrolls, when arranged as aforesaid, can be reduced in size, or miniaturized, and used in conjunction with small appliances, or even in hand-held instruments, as for example, for use in conducting mass spectrometry, or for other purposes. The actual structure of the multi-stage devices can include the fixed and orbiting scrolls adjacent the motor, or the singular motor may be located intermediate various stages of the formed vacuum pump/compressor, in its assembly.

23 Claims, 10 Drawing Sheets

Related U.S. Application Data is a continuation-in-part of application No. 13/987,486, filed on Jul. 30, 2013, now Pat. No. 9,028,230, which is a continuation-in-part of application No. 13/066,261, filed on Apr. 11, 2011, now Pat. No. 8,523,544.

(60) Provisional application No. 62/179,437, filed on May 7, 2015, provisional application No. 61/342,690, filed on Apr. 16, 2010.

(51) Int. Cl.
*F04C 23/00* (2006.01)
*F04C 23/02* (2006.01)
*F04C 25/02* (2006.01)

(52) U.S. Cl.
CPC ..... *F04C 18/0284* (2013.01); *F04C 23/02* (2013.01); *F04C 25/02* (2013.01); *F04C 29/0085* (2013.01); *F04C 29/005* (2013.01); *F04C 2240/20* (2013.01); *F04C 2240/30* (2013.01); *F04C 2240/603* (2013.01)

(58) Field of Classification Search
USPC ..... 418/55.3, 55.1, 60, 55.5, 57, 3
See application file for complete search history.

(56) References Cited

U.S. PATENT DOCUMENTS

| | | | | |
|---|---|---|---|---|
| 3,902,809 | A | 9/1975 | Sparks | |
| 3,986,799 | A | 10/1976 | McCullough | |
| 3,994,636 | A | 11/1976 | McCullough et al. | |
| 4,192,152 | A | 3/1980 | Armstrong et al. | |
| 4,340,339 | A | 7/1982 | Hiraga et al. | |
| 4,415,317 | A | 11/1983 | Butterworth | |
| 4,416,597 | A | 11/1983 | Eber et al. | |
| 4,462,771 | A | 7/1984 | Teegarden | |
| 4,718,836 | A | 1/1988 | Pottier et al. | |
| 4,730,375 | A | 3/1988 | Nakamura et al. | |
| 4,867,657 | A | 9/1989 | Kotlarek et al. | |
| 4,892,469 | A | 1/1990 | McCullough et al. | |
| 5,037,280 | A * | 8/1991 | Nishida | F01C 17/066 418/55.3 |
| 5,160,253 | A | 11/1992 | Okada et al. | |
| 5,338,159 | A * | 8/1994 | Riffe | F04C 18/023 417/203 |
| 5,466,134 | A | 11/1995 | Shaffer et al. | |
| 5,616,015 | A * | 4/1997 | Liepert | F01C 17/063 418/5 |
| 5,632,612 | A | 5/1997 | Shaffer | |
| 5,632,613 | A | 5/1997 | Shin et al. | |
| 5,752,816 | A | 5/1998 | Shaffer | |
| 5,759,020 | A | 6/1998 | Shaffer | |
| 5,855,473 | A | 1/1999 | Liepert | |
| 5,951,268 | A | 9/1999 | Pottier et al. | |
| 5,987,894 | A | 11/1999 | Claudet | |
| 6,050,792 | A | 4/2000 | Shaffer | |
| 6,129,530 | A | 10/2000 | Shaffer | |
| 6,190,145 | B1 | 2/2001 | Fujioka et al. | |
| 6,379,134 | B2 | 4/2002 | Iizuka | |
| 6,439,864 | B1 | 8/2002 | Shaffer | |
| 6,511,308 | B2 | 1/2003 | Shaffer | |
| 7,942,655 | B2 | 5/2011 | Shaffer | |
| 8,523,544 | B2 | 9/2013 | Shaffer | |
| 8,668,479 | B2 | 3/2014 | Shaffer | |
| 9,028,230 | B2 | 5/2015 | Shaffer | |
| 2007/0108934 | A1 | 5/2007 | Smith et al. | |
| 2007/0172373 | A1 | 7/2007 | Ni | |
| 2007/0189912 | A1 | 8/2007 | Shaffer | |
| 2008/0193311 | A1 * | 8/2008 | Helies | F04C 18/0215 418/55.3 |
| 2009/0148327 | A1 * | 6/2009 | Carter | F01C 1/0215 418/55.1 |
| 2009/0246055 | A1 | 10/2009 | Stehouwer et al. | |
| 2011/0176948 | A1 | 7/2011 | Shaffer | |
| 2011/0256007 | A1 | 10/2011 | Shaffer | |

* cited by examiner

MULTI STAGE SCROLL VACUUM PUMPS AND RELATED SCROLL DEVICES

CROSS REFERENCE TO RELATED APPLICATION

This non-provisional patent application claims priority to the provisional patent application having Ser. No. 62/179,437, filed on May 7, 2015; and this non-provisional patent application claims priority to the non-provisional patent application having Ser. No. 14/544,874, filed on Feb. 27, 2015, which claims priority as a continuation-in-part patent application to the patent application having Ser. No. 13/987,486, filed on Jul. 30, 2013, now U.S. Pat. No. 9,028,230, which claims priority to the non-provisional patent application having Ser. No. 13/066,261, filed on Apr. 11, 2011, now U.S. Pat. No. 8,523,544, which claims priority to the provisional patent application having Ser. No. 61/342,690, filed on Apr. 16, 2010.

FIELD OF THE INVENTION

This invention is related to the field of vacuum pumps, expanders and compressors, and scroll type vacuum pumps, expanders and compressors in particular. The invention describes several inventive configurations for multi-stage scroll type vacuum pumps, expanders and compressors, for the purpose of achieving higher vacuums or pressures, including related scroll devices.

BACKGROUND OF THE INVENTION

Various stage vacuum pumps, and alternatively expanders, generally relate to devices that alter or reduce the pressure of gases within a container, typically to very low vacuums, or alternatively produce power as a gas expands. More specifically, these devices refer to multiple stages of scrolls that greatly increase the vacuums or pressures obtained during usage.

Scroll devices have been used as compressors, expanders and vacuum pumps for many years. In general, they have been limited to a single stage of compression due to the complexity of two or more stages, formed for compression, and for operation. In a single stage, a spiral involute or scroll upon a rotating plate orbits within a fix spiral or scroll upon a stationary plate. A motor shaft turns a shaft that orbits a scroll eccentrically within a fixed scroll and the eccentric orbit forces a gas through and out of the fixed scroll, thus creating a vacuum in a container in communication with the outlet from the fixed scroll. An expander operates under the same principle, only turning the scrolls in reverse, during their operations. When referring to compressors, it is understood that a vacuum pump can be substituted for a compressor, and that the expander can be an alternate usage when the scrolls operate in reverse from an expanding gas.

Often oil is used during manufacture and operations of compressors. Oil free or oil less scroll type compressors and vacuum pumps have difficult and expensive manufacturing, due to the high precision of the scroll in each pump and compressor. For oil lubricated equipment, swing links often minimize the leakage from gaps in the scrolls by allowing the scrolls to contact the plate of the scroll. Such links can not be used in an oil free piece of equipment because of the friction and wear upon the scrolls. If the fixed and orbiting scrolls and oil free equipment lack precision, leakage will occur and the equipment performance will decline as vacuums take longer to induce or do not arise at all.

Prior art designs have previously improved vacuum pumps, particularly in the design of the tips of the scrolls. In the preceding work of this inventor, U.S. Pat. No. 6,511,308, a sealant is applied to the two stage scrolls during manufacturing. The pump with the sealant upon the scrolls is then operated which distributes the sealant between the scrolls. The pump is then disassembled and lets the sealant cure. After curing the sealant, the pump is reassembled for use. During use, this patented pump only achieves a vacuum on the order of 100 mt.

In addition, the current inventor has a variety of patents that relate to two stage scroll devices. For example, Mr. Shaffer's U.S. Pat. No. 6,439,864, is upon a Two Stage Scroll Vacuum Pump With Improved Pressure Ratio and Performance. The various stages of this pump and spiral involute wraps are of differing sizes in the different stages of the pump construction. This has an effect upon the compression ratio in the operations of the pump, in order to increase its efficiency.

Another patent to Shaffer, U.S. Pat. No. 7,942,655, discloses an advance scroll compressor, vacuum pump, and expander. This device uses bellows that spans between the fixed and orbiting scrolls and hermetically seals the scroll device during its functioning. The bellows also accommodates liquid cooling of the compressor during its operations.

A further patent to Mr. Shaffer, U.S. Pat. No. 8,523,544, shows another three stage scroll vacuum pump. This pump has three stages of fixed scrolls and orbiting scrolls that operate simultaneously. The structure of the scrolls, or the housing for the pump, incorporates fins that have the effect of a heat sink for disseminating the generated heat of the vacuum pump, during its operations.

A further published application of the inventor, U.S. 2011/0176948, discloses a semi-hermetic scroll compressor, vacuum pump, and expander. This invention also incorporated heat sinks upon its structure in order to increase the heat transfer from the compressor during its functioning.

A further published application of the inventor herein is upon a three stage scroll vacuum pump, published under No. U.S. 2011/0256007. This device incorporates magnetic couplings in order to attain the functioning of its orbiting scroll, so that atmosphere does not infiltrate the pump during its usage.

A unique aspect of the present disclosure is the use of a multi-stage scroll vacuum pump and/or compressor, that may be used to attain and is capable of achieving very high vacuums, (low absolute pressures), or high pressures for a multi-stage compressor that are very desirable for a number of applications.

Other U.S. patents have shown related technology, and U.S. Pat. No. 3,802,809, which issued to Vulliez, disclosed a pump having a scroll orbiting within its fixed scroll. Beneath the fixed disc, a bellows guides the gases evacuated from a container. The bellows spans between the involute and the housing, nearly the height of the pump. The pump and many other parts are cooled by ambient air in the vicinity of the pump.

The patent to Mulhouse, et al, U.S. Pat. No. 3,011,694, discloses an encapsulating device for expanders, compressors or the like. Thus, it shows an early multi type of compressor, pump or expander, as noted.

A patent to McCullough, U.S. Pat. No. 3,986,799, shows a fluid-cooled, scroll-type, positive fluid displacement apparatus. It utilizes stationary and orbiting scroll members of a scroll-type apparatus.

A further patent to McCullough, and the inventor herein, early on, U.S. Pat. No. 3,994,636, shows an axial compliance means with radial sealing for scroll-type apparatus.

A further patent to McCullough, et al, U.S. Pat. No. 4,192,152, shows another scroll-type fluid displacement apparatus with peripheral drive.

The patent to Hiraga, et al, U.S. Pat. No. 4,340,339, shows a scroll-type compressor with oil passageways through its housing.

The patent to Buttersworth, U.S. Pat. No. 4,415,317, discloses a wrap element and tip seal for use in fluid apparatus of the scroll-type. The purpose for the seal is to enhance the efficiency of operations of the device for both compression and for pumping purposes.

The patent to Eber, et al, U.S. Pat. No. 4,416,597, shows a further tip seal back-up member for use in fluid apparatus of the scroll-type.

The patent to Teegarden, U.S. Pat. No. 4,462,771, shows another improvement upon a wrap element and tip seal for use in fluid apparatus of the scroll-type and the method for making same.

The patent to Leclaire, et al, U.S. Pat. No. 4,718,836, shows a reciprocating completely sealed fluid-tight vacuum pump.

The patent to Nakamura, et al, U.S. Pat. No. 4,730,375, shows a method for the assembly of a scroll-type apparatus.

The patent to Kotlarek, et al, U.S. Pat. No. 4,867,657, shows a scroll compressor with axial balanced shaft.

Another patent to McCullough, et al, U.S. Pat. No. 4,892,469, shows a compact scroll-type fluid compressor with swing-link driving means.

The scroll-type fluid apparatus having sealing member in the recess forming the suction space, to Okada, et al, is disclosed in patent U.S. Pat. No. 5,160,253.

It should be noted that most of these prior art patents relate to a single plate pair for use within compressor apparatus.

A further patent to the inventor herein, Mr. Shaffer, U.S. Pat. No. 5,466,134, is upon a scroll compressor having idler cranks and strengthening and heat dissipating ribs. This is also upon a single plate pair for forming the scroll compressor.

Another patent to the inventor herein, Mr. Shaffer, is U.S. Pat. No. 5,632,612, shows a scroll compressor incorporating a tip seal.

The patent to Shin, et al, U.S. Pat. No. 5,632,613, shows a lubricating device for horizontal type hermetic compressor.

Another patent to Shaffer, U.S. Pat. No. 5,752,816, shows a scroll fluid displacement apparatus with improved sealing means.

A further patent to the inventor herein, U.S. Pat. No. 5,759,020, shows a scroll compressor having the tip seals and idler crank assemblies.

The patent to Liepert, U.S. Pat. No. 5,855,473, shows a displacement rate, scroll-type fluid handling apparatus.

The patent to Pottier, et al, U.S. Pat. No. 5,951,268, shows a spherical vacuum pump having a metal bellows for limiting circular translation movement.

A further patent showing various scrolls is disclosed in the patent to Claudet, U.S. Pat. No. 5,987,894, disclosing a temperature lowering apparatus using cryogenic expansion with the aid of spirals.

Another patent to the inventor herein, U.S. Pat. No. 6,050,792, shows a multi-stage scroll compressor.

Another patent to the inventor herein, Mr. Shaffer, U.S. Pat. No. 6,129,530, discloses a scroll compressor with a two piece idler shaft and two piece scroll plates. This is just a plate pair forming a scroll compressor.

The patent to Fujioka, et al, U.S. Pat. No. 6,190,145, shows a further scroll fluid machine.

A patent to Lizuka, U.S. Pat. No. 6,379,134, discloses a scroll compressor having paired fixed and movable scrolls. This is a multi-scroll compressor that incorporates a pair of fixed scrolls, and orbiting scrolls.

A published application to Ni, U.S. 2007/0172373, shows a scroll-type fluid displacement apparatus with fully compliant floating scrolls.

The published application to Stehouwer, et al, No. U.S. 2009/0246055, shows a discharge chamber for dual drive scroll compressor.

These are examples of the prior art known to the applicant herein.

In some applications scroll-type vacuum pumps have notoriety for achieving high vacuums. A few large scroll vacuums pumps can achieve vacuums as high as 50 mt. However industry, science, and research still demands compact vacuum pumps, including compressors, that can yet achieve higher vacuums and high pressure gas.

The present invention overcomes the limitations of the prior art where the need exist for higher vacuums in equipment of compact form. That is, the art of the present disclosure, a multi-stage scroll vacuum pump, utilizes structure that allows for the generation of very high vacuums, when formed as a pump, or when constructed as a compressor, can attain very high pressures, from smaller equipment, for use for operating more compact machinery and equipment, even in hand held devices, in both industrial and cooling and heating equipment, amongst other applications.

SUMMARY OF THE INVENTION

The concept of this invention is to present, in the examples as set forth, three multi-stage and one single stage vacuum pump configurations, each with unique advantages for achieving high vacuum levels in a small package.

Vacuum pumps that are capable of achieving very high vacuums are desirable in a number of applications as previously explained, such as in mass spectrometry. One way to achieve the higher vacuums is to use several stages in series. As previously reviewed in the background, several patents by the inventor herein have issued for a two stage and three stage scroll-type vacuum pump. However, there exist applications where a more compact, or higher vacuum is desirable, such as a hand held mass spectrometer device. Vacuum pumps for hand held mass spectrometers must be extremely compact and light of weight, as can be understood, while delivering very high vacuum levels with lower power consumption.

It needs to be noted herein, that while the examples as described, shown and set forth in this application, for the invention, is described as a vacuum pump, that concepts could just as easily be configured for use as a compressor for generating higher pressures.

The first design of this current invention is either a single stage or a two stage scroll vacuum pump of the spinning scroll or co-rotating scroll-type. The advantage of the spinning scroll is that the motion is pure rotation, so that the scrolls can be perfectly balanced. With the scrolls being balanced, very high rotational speeds are possible, resulting in a very compact vacuum pump, one that is highly efficient and effective of operations, and can be operated for lengthy periods of time. The spinning scroll can be configured as a single stage vacuum pump, when high vacuum is not needed, and as a two stage pump, or more, for higher vacuums.

The second design of the improvements as described herein is a three stage vacuum pump. This design incorporates a first and second stage pumping section operating in parallel, flowing into a third pumping stage arranged in series to the said first and second stages. The design is of the orbiting scroll type, which is the most common type scroll device. The advantages of this design is that large displacements (flow) are possible in a compact package due to the first and second stages being in parallel, while high vacuums are achievable within the third stage during its operations, which is arranged, as aforesaid, in series with the first two stages.

In a third design, this invention incorporates a four stage orbital type scroll vacuum pump. Once again, it could be incorporated and assembled into a four stage orbital compressor. This design has the first and second stages in parallel for high displacement (flow), and a third and fourth stage in series to attain ultra-high vacuums. This results in a relatively compact design for the generation of very high vacuums.

In a fourth design, a two stage in series design with a first stage being arranged closer to the motor so that a part of the motor is within the first stage, and the second stage is outboard of the motor. The flow of the gasses are similar to U.S. Pat. No. 6,439,864. The advantage of this configuration is a more compact design and lighter weight.

Regardless of the number of stages involved, the invention further incorporates a unique tip seal design related to spinning scroll technology that will self actuate into effective sealing due to the spinning motion of the scroll. This invention also incorporates a method for aligning the scrolls to each other, for proper running clearance, when the Idler shafts are not present. This is particularly so when the pump or compressor is of the co-rotating type.

Once again the descriptions for a vacuum pump, and the designs as described herein could just as easily be made into a compressor, and the term "vacuum pump" and "compressor" will be used to mean either type of design, in the description of the developments herein. Obviously, when the orbiting scroll is moved in one direction, it functions as a pump, but when orbited in an opposite direction, can function as an expander.

It is, therefore, the principal object of this invention to provide a multi-stage scroll vacuum pump or gas compressor, that may provide various scrolls arranged in parallel, and/or in series, in order to attain the generation of very high vacuums, or very high gas pressure, and because of the multi stages of the structures involved, can be miniaturized in their structure and assembly, to minimize the space requirement for the use and application of these devices, even in smaller instrumentation such as for use in mass spectrometry and related applications.

Other objects may become more apparent to those skilled in the art upon review of the summary of the invention as provided herein, and upon undertaking a study of the description of its preferred embodiments, in view of the drawings.

Figure 1:
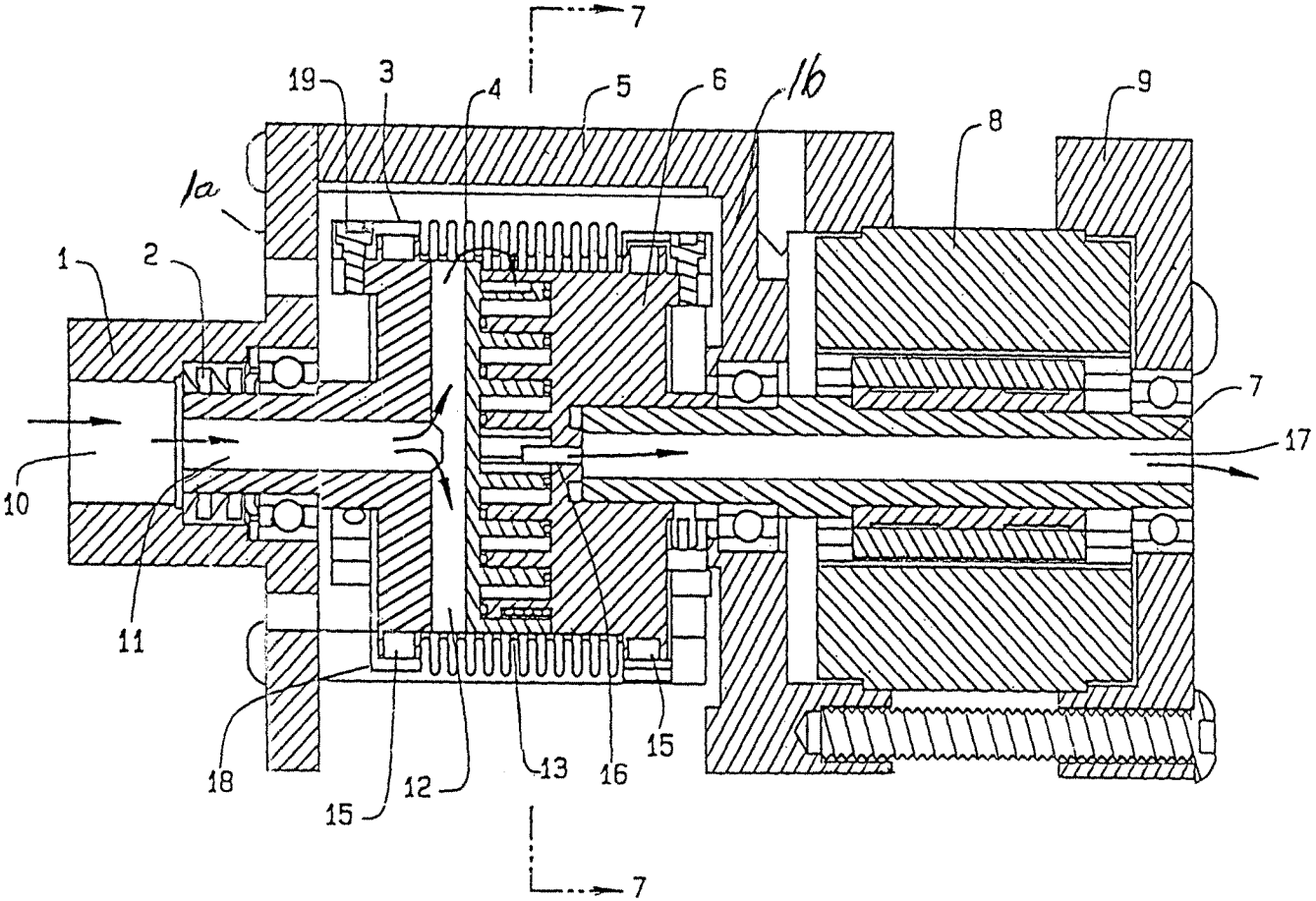
FIG. 1 provides a cross sectional view of the single stage spinning or co-rotating scroll vacuum pump/compressor design of this invention.

Identification of the various components parts of the pump/compressor designs of this invention are as follows:

Referring to FIG. 1 and FIG. 5, the major component parts are:

1. Driven scroll housing
2. Shaft seal
3. Driven scroll
4. Bellows
5. Drive scroll housing
6. Drive scroll
7. Drive Shaft
8. Motor
9. Back motor bracket
10. Inlet port
11. Port
12. Cross hole
13. Inlet plenum
15. O-rings
16. Port
17. Hole or Passage
18. Clamp
19. Screws Referring to FIG. 2, the major component parts are:

29. Cross hole
30. Outlet
31. Bellows
32. Second stage inlet plenum Referring to FIG. 3, the major component parts are:

33. Fixed scroll first stage
34. Orbiting scroll first and second stage
35. Fixed scroll second stage
36. Orbiting scroll third stage
37. Fixed scroll third stage
38. Crankshaft
39. Motor housing
40. Motor
41. Counterweight

42. Idler shafts
43. Inlet port
44. Second stage location port
45. Discharge plenum
46. Port
47. Third stage inlet plenum
48. Annular air movement space
49. Counterweight
50. Eccentric Referring to FIG. 4, the major components are:

51. Fixed scroll first stage
52. Orbiting scroll first and second stage
53. Fixed scroll second stage
54. Drive housing
55. Motor housing
56. Motor
57. Fixed scroll third stage
58. Orbiting scroll third and fourth stage
59. Fixed scroll fourth stage
60. Crankshaft and counterweight
61. Motor drive shaft
62. Idler shaft first stage
63. Idler shaft third stage
64. Crankshaft and counterweight
65. Inlet port
66. First and second stage inlet plenum
67. Scroll passage
68. Passage
69. Annular air passage area
70. Opening
71. Port
72. Third stage discharge plenum
73. Fourth stage discharge port
74. Cover
75. Cover Referring to FIGS. 6 and 7, the major components are:

3. Driven scroll
6. Drive scroll
18. Bellows clamp
19. Screws
20. Hole
21. Hole
22. Hole
23. Hole
24. Plugs
25. Plugs
26. Fit Referring to FIGS. 8A and 8B, the major components are:

101. Involute
100. Tip seal
102. Tip seal
103. Groove for o-ring

DESCRIPTION OF THE PREFERRED EMBODIMENT

In referring to the drawings, FIG. 1 shows a cross-sectional view of the single stage spinning or co-rotating scroll vacuum pump/compressor design of this invention. It includes the various components as previously identified, such as the driven scroll housing 1, provided with a shaft seal 2, and a driven scroll 3. Item 4 provides a bellows that surrounds the driven scroll, that seals the generated pressures, whether it be derived from a vacuum pump, or a compressor that generates high pressure, in its operations: A drive scroll housing 5 surrounds these operative components. The drive scroll 6 has its various scrolls interconnected with the driven scroll 3, as shown. A drive shaft 7, connects with the drive scroll 6, to provide for its rotation relative to the driven scroll, and the drive shaft 7 is rotated by means of the motor 8, as can be noted. There is a back motor bracket 9 that is provided for mounting of the motor, and its pump/compressor, in its configured assembly.

In referring to the drawings, FIG. 1 shows a cross-sectional view of the single stage spinning or co-rotating scroll vacuum pump/compressor design of this invention. It includes the various components as previously identified, such as the driven scroll housing 1, provided with a shaft seal 2, and a driven scroll 3. Item 4 provides a bellows that surrounds the driven scroll, that seals the generated pressures, whether it be derived from a vacuum pump, or a compressor that generates high pressure, in its operations. A drive scroll housing 5 surrounds these operative components. The drive scroll 6 has its various scrolls interconnected with the driven scroll 3, as shown. A drive shaft 7, connects with the drive scroll 6, to provide for its rotation relative to the driven scroll, and the drive shaft 7 is rotated by means of the motor 8, as can be noted. There is a back motor bracket 9 that is provided for mounting of the motor, and its pump/compressor, in its configured assembly. The housing 5 has a pair of end plates 1*a* and 1*b*, with the end plate 1*a* being integral with the driven scroll housing 1.

Gas to be evacuated or compressed enters the spinning scroll pump through the inlet port 10, in the driven scroll housing 1, as noted. The gas is sealed from leaking to the atmosphere through the rotary shaft seal 2, as disclosed. In this figure, two lip seals are shown, however, other type seals such as a labyrinth or mechanical seal can also be utilized. The gas enters the driven scroll 3 through the central port 11, as noted. The port 11 intersects a cross path 12, that directs the gas to the inlet plenum 13, on the peripheries of the arranged scrolls. The inlet plenum 13 is bounded on the outside by the identified flexible bellows 4, which is sealed on its ends by use of the various o-rings 15, as can be noted. The gas then enters the scrolls, and is compressed, through the operations of said scrolls, and then discharged at the center of the drive scroll 6, as at its port 16. The gas then flows through the aperture 17, within the shaft 7, and is discharged to its site of usage. Obviously, the shaft 7 is turned by the motor 8. The bellows 4 performs the function of sealing the inlet chamber 13 from the atmosphere, and also maintains the phase relationship between the drive scroll 6, and the driven scroll 3, in its operations. The driven scroll 3 is driven by the bellows 4. The clamps 18 are designed so that the bellows 4 is retained without increasing the diameter of the assembly, thus keeping the entire pump very compact. As previously summarized, the concept of this invention is to provide for either a parallel arrangement of a series of scroll pump/compressors, or series arranged pump/compressors, or a combination of the two, which can provide for a very high generation of a pressure, or evacuation of a vacuum, within a small scale apparatus, that may even be accommodative of a hand-held type of device, during its usage and application.

Figure 6:
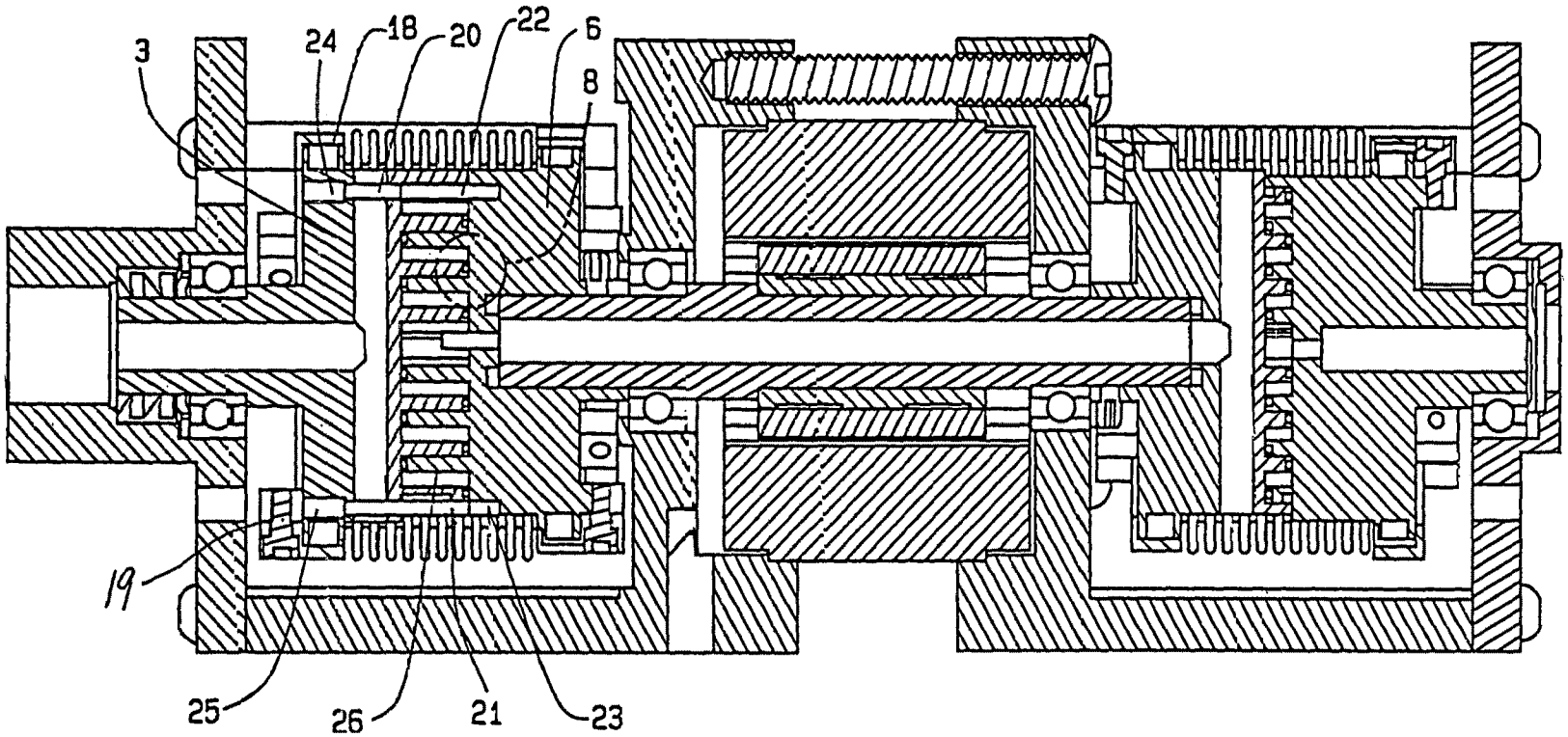
FIG. 6 discloses an innovative alignment method for maintaining the phase relationship and running clearances for the scrolls of this invention, when assembled as the spinning scroll type or an orbiting scroll type where idler shafts are not present for alignment, with FIG. 6 being a section taken along the line 6-6 of FIG. 7.

The phase relationship between the two scrolls 3 and 6, and their alignment within its assembly is achieved by the alignment pins fixture as shown in FIG. 6, as subsequently described.

Figure 1A:
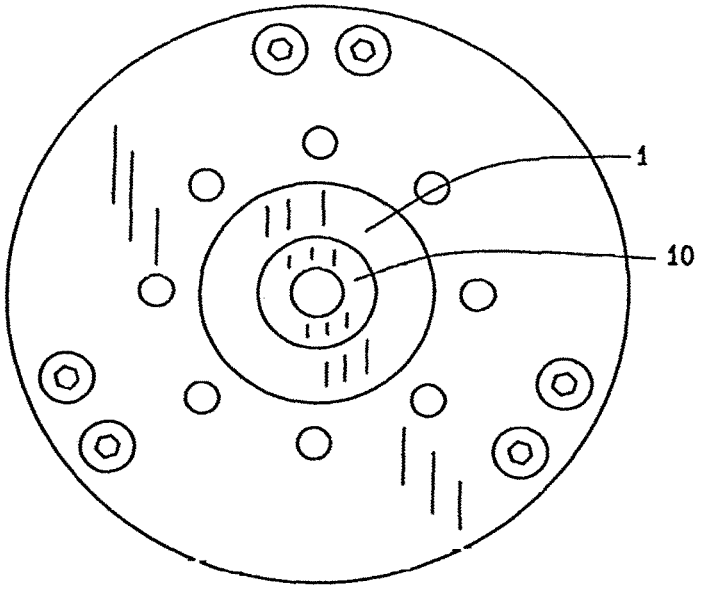
FIG. 1A provides a right end view of the design of FIG. 1.
Figure 1B:
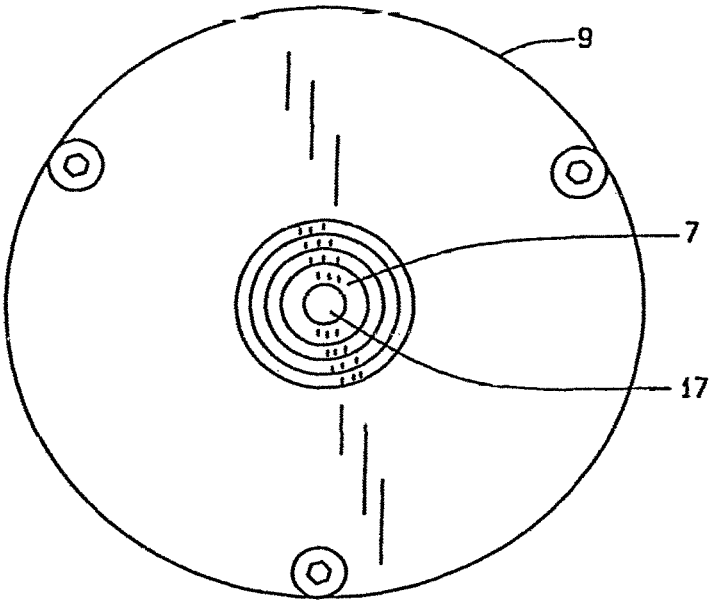
FIG. 1B is a left end view of the design of FIG. 1.

As previously described, FIG. 1A provides a left end view of the pump housing, as noted in FIG. 1, while FIG. 1B provides a right end view of the housing, particularly its back motor bracket 9, as previously defined.

Figure 2:
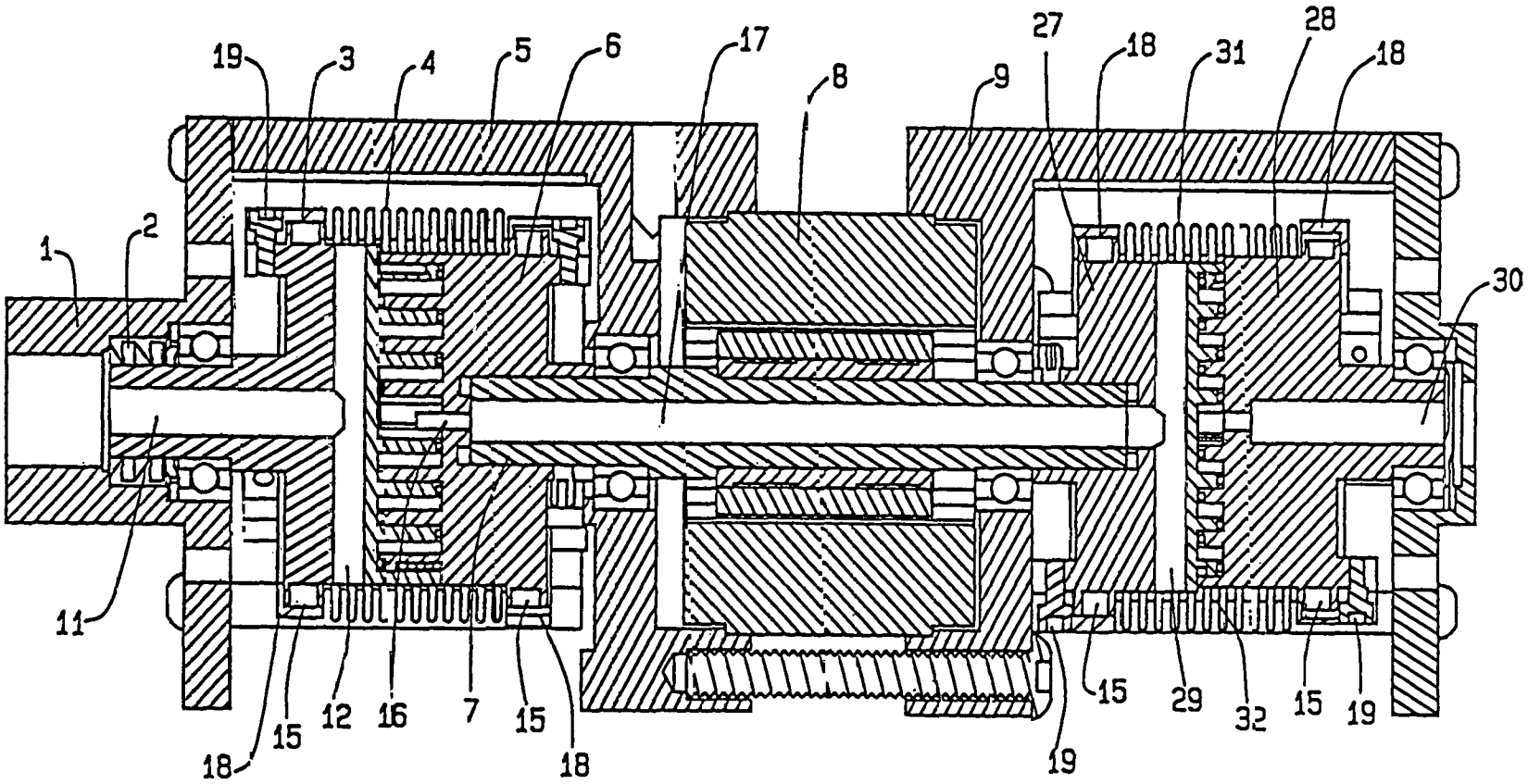
FIG. 2 shows a cross sectional view of the two stage spinning scroll vacuum pump or compressor design of this invention.

FIG. 2 discloses a further modifications to the single stage scroll vacuum pump/compressor design of FIG. 1, but in this particular instance, it includes, in series, a second scroll vacuum pump or compressor design, as noted. In this particular instance, the back motor bracket is integrally extended rearwardly, and mounts a second scroll vacuum pump or compressor design. As can be seen, the motor or drive shaft 7 further turns a driven scroll 27, which is held into position for eccentrically shifting by means of the clamps 18, that secure the o-rings 15 in position around the perimeter of the scroll plate. The high pressure or vacuum that is transferred through the passage 17, within the drive shaft 7, exits into the cross hole 29, then into the second stage inlet plenum 32. At this point the gas is subjected to the operations of the movable scroll 27 and the driven scroll 28, and further increases in pressure, or generates further vacuum pressure, which then exits out of the passage 30, for use for purposes of such generated vacuum or compressed gas, as a result of operations of the scroll vacuum pump or compressor design of this invention. Once again, a bellows means 31 is provided between the clamps 18, to assure the hermetic sealing of the scroll compressor, therein, during its functioning. The various screws 19 cooperating with the clamps 18 secure the bellows 31 to the assembly.

This is an example of how a pair of co-rotating scrolls, maintained in series, can provide for a high efficiency in generating a vacuum, or a high pressure gas, in a fairly reduced dimensioned design, as noted and described herein.

The phase relationship between the two scrolls 3 and 6, as previously explained, as positioned within the assembly is achieved through usage of the alignment pin fixture, in the manner as to be subsequently described in FIGS. 6 and 7.

Figure 7:
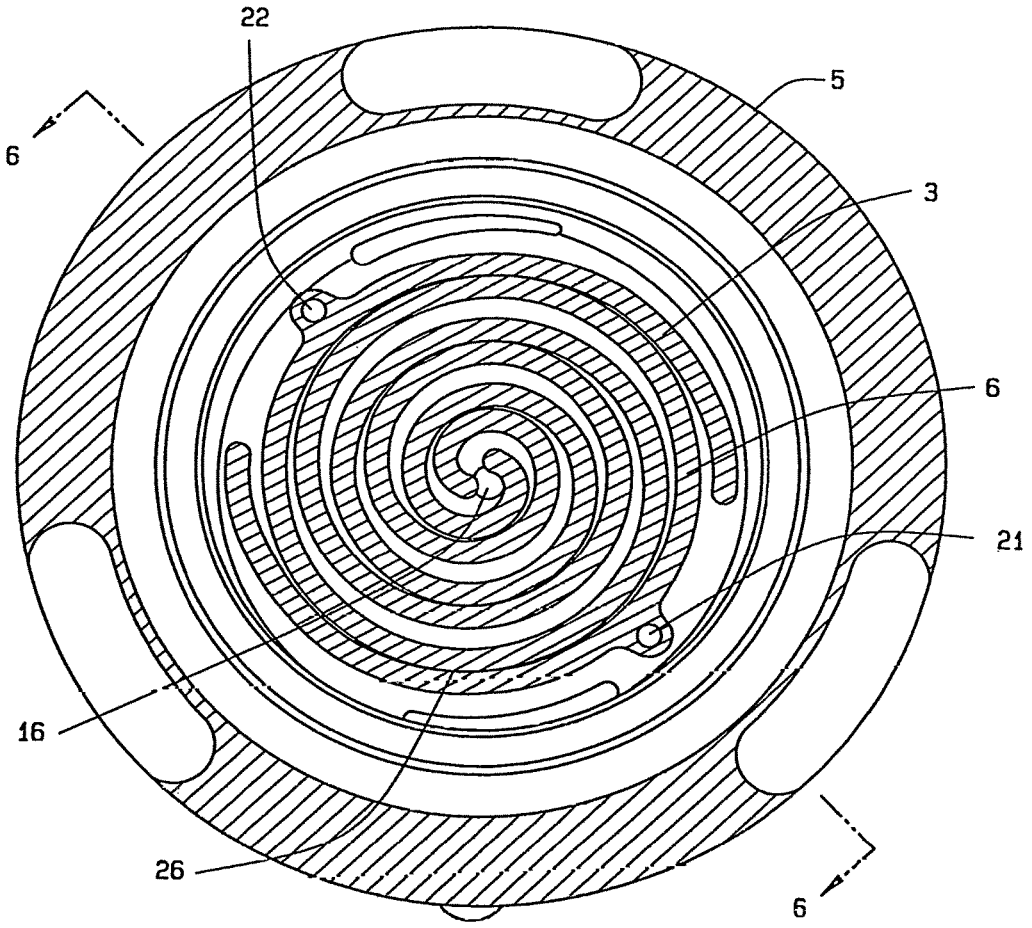
FIG. 7 shows an alignment method for maintaining the phased relationship and running clearances for the scrolls used in this invention, FIG. 7 taken along the line 7-7 of FIG. 1.

In FIG. 6, in addition to FIG. 7, the apertures 20 and 21 are precision located into the driven scroll 3. Likewise, the apertures 22 and 23 are precision located in the drive scroll 6. There are four such apertures 20-23, that are located such that when a close fitting pin is inserted into the apertures 20, thereby engaging the aperture 22, and another close fitting pin is inserted into the aperture 21, engaging the aperture 23, the alignment between the two scrolls will be precisely as desired so that the fit between the two scrolls will be maintained, and also so that the "phase" relationship between the scrolls is as required and desired for precise operation. In FIG. 7, the scroll and position of the drive scroll 6 relative to the drive scroll 3 must be properly aligned or "phased" for proper operation of the unit.

While the alignment pins are engaged, the bellows clamp 18 is positioned and bolted into place through usage of the screw 19, as previously described, so that the positioning of the scrolls 3 and 6 will be maintained after the alignment pins are removed. The final step is to seal the apertures 20 and 21 with plugs 24 and 25, so there will be no leakage of the vacuum generated gas or compressed gas to the atmosphere.

Figure 8A:
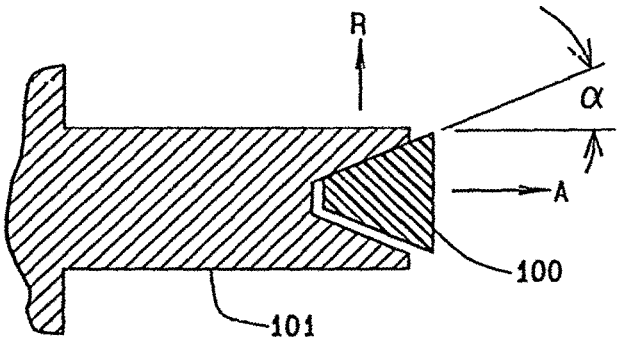
FIGS. 8A and 8B show an enlarged view of the tip seals used in the structure of the compressors/pump scrolls of this invention, generally as can be noted as located in FIG. 6 of this disclosure.
Figure 8B:
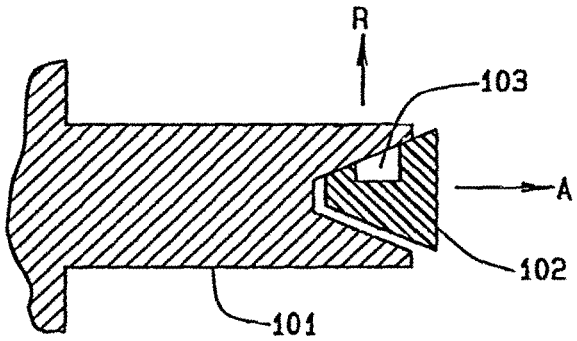

FIG. 8 shows the enlarged view of the tip seals located at the end of each scroll, generally as shown in the enlarged view identified at 8, in FIG. 6. This shows the enlarged views of two different tip seal designs for use in the spinning type scroll devices, vacuum pumps, compressors, or expanders. In describing the schematics as shown in FIGS. 8A and 8B, the centrifugal forces are shown as "R" and their direction of force as noted in said figure. This will cause the tip seals to jam in a traditional tip seal sense where the angle $\alpha$ is zero. By making the tip seal slides slightly tapered with an angle $\alpha$ greater than zero, the centrifugal forces in the "R" direction will cause a component of force in the axial direction "A", thus forcing the tip seal to move in the "A" direction and engage the inner surface of the adjacent scroll, thereby effectively enhancing the sealing of any leakage from any pressure differential that exists across the involute, during its functioning.

FIG. 8A shows one embodiment of the invention where the tip seal 100 is trapezoidal of shape, and has the same a angle as the groove in the involute 101. FIG. 8B is the same as FIG. 8A, except the tip seal 102 has a groove 103 for placement of an o-ring cord stock therein, to further enhance the sealing activity of the scrolls, during their functioning.

Figure 3:
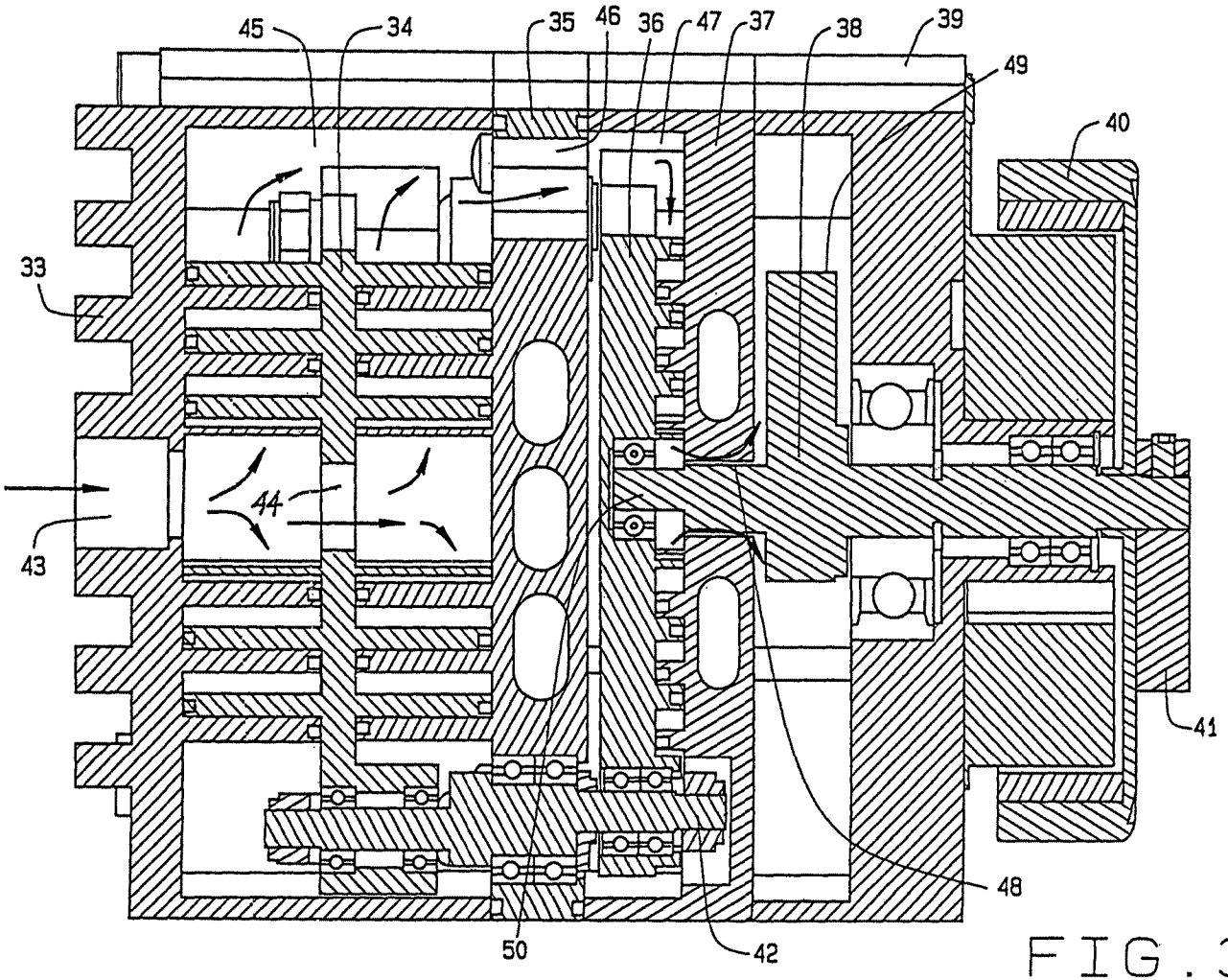
FIG. 3 shows a cross sectional view of the three stage scroll vacuum pump or compressor design of this invention.

In referring to FIG. 3, and as previously summarized, this design is shown in a three stage vacuum pump. The design incorporates its first and second stage pumping sections, that operate in parallel, providing for the transfer of its compressed gas for flow into a third pumping stage, arranged in a series, with the first and second stages. The design is of the orbiting scroll type, as known in the art. The advantage of this design is that large displacements, or flow, are possible in a compact package due to the first and second stages being arranged in parallel, while the high vacuums are achievable through the use of the third stage, arranged in series.

During its functioning, the gas to be evacuated or compressed enters the first stage fixed scroll 33, at its inlet port 43. The gas also enters the second stage at the location 44, in the orbiting scroll 34. The gas is then expanded in these first and second stages to the first and second stage discharge plenum 45. The gas then travels through the port 46, in the second stage fixed scroll 35, and into the third stage inlet plenum 47. The gas then enters into the third stage formed by the third stage fixed and orbiting scrolls 36 and 37, respectively. The gas is then compressed in the third stage and is discharged through the annular space 48 between the third stage fixed scroll and the crank shaft 37 and 38. The gas is then discharged through the housing 39, for further usage.

Counterweights are located at 49 and 41, to balance the orbital motion of the orbiting scrolls 34 and 36. The eccentric 50, located on the crank shaft 38, drives the orbiting scroll 36. Three idler shafts 42 are arranged and positioned approximately 120° apart from each other, around the second stage fixed scroll 35, and the third stage orbiting scroll 36, in addition to the orbiting scroll 34, that locate the orbiting scrolls 34 and 36 relative to the fixed scrolls 33, 35, and 37. The idler shafts 42 are supported by their ball bearings, as shown. The idler shafts 42 also serve to maintain the relative "phase" relationship between the fixed and orbiting scrolls, and also serve to drive the second stage orbiting scroll 34.

Figure 4:
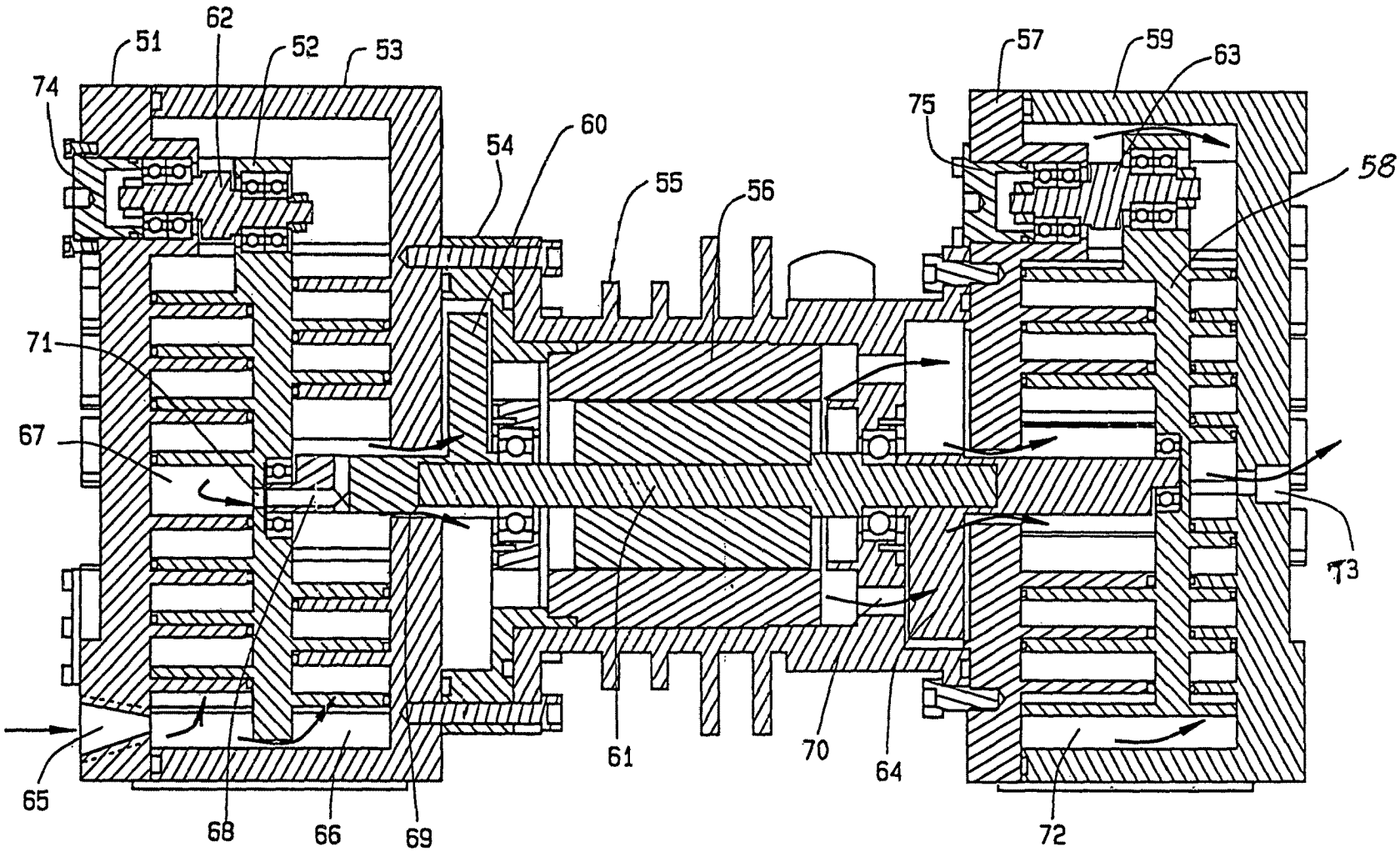
FIG. 4 shows a cross sectional view of the four stage vacuum pump or compressor design of this invention.

As noted in FIG. 4, this particular design is of a four stage orbital type scroll vacuum pump. This design has the first and second stages in parallel, for high displacement, or flow, and then includes a third and fourth stage in series, for generating ultra-high vacuums. This results in a relatively compact unit, for this design, that generates ultra-high vacuums. It may also be structured as a pump or compressor.

In this four stage orbital type scroll vacuum pump or compressor, the gas to be evacuated enters the fixed scroll first stage 51, at the inlet port 65. The gas then travels into the first and second stage inlet plenum 66. The first and second stages are in parallel to increase the displacement of the pump while keeping the unit of compact design. After compression, the gas in the first stage travels through the port 71, and then into the passage 68 into the second stage. From there, the combined flow from the first and second stages travels through the annular area 69, as noted, formed by the crank shaft 60 and the fixed scroll second stage 53. The gas then travels past the motor 56 and into the opening 70. The gas enters the center of the third stage through the annular area formed by the crank shaft 64, and the fixed scroll third stage 57. After expansion, the gas enters the plenum 72, and is then compressed in the fourth stage, and exits the unit through the port 73, in the fixed scroll fourth stage. From there, the gas exits out of the port 73, as can be noted, after passing through the fourth compression stage.

There are three idler shafts 62 and 63 at each scroll pair, that are positioned so that any axial forces can be counteractive and for maintaining the axial positioning of the orbiting scrolls 52 and 58, and for attaining the "phase" relationship between the identified scrolls. The covers 74 and 75 are used to seal the openings in the fixed scrolls 51 and 57. The two orbiting scrolls 52 and 58 are driven by the motor 56, generally in the manner as previously described in earlier designs. The motor rotor turns the shaft 61, which has eccentric crank shafts 60 and 64, with their counterweights for balancing of the unit, during operations. These counterweights are noted at 60 and 64.

Figure 5C:
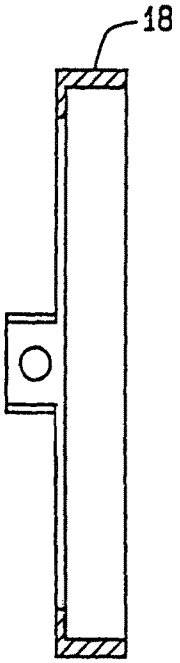
FIGS. 5A through 5C shows a new compact clamping method and apparatus for the bellows of FIG. 1 and FIG. 2, which allows for clamping of the bellows within the same outer diameter of the bellows structure.
Figure 5B:
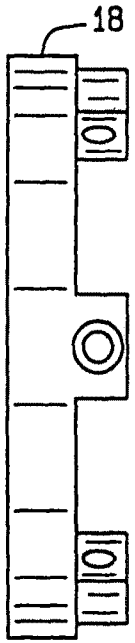
Figure 5A:
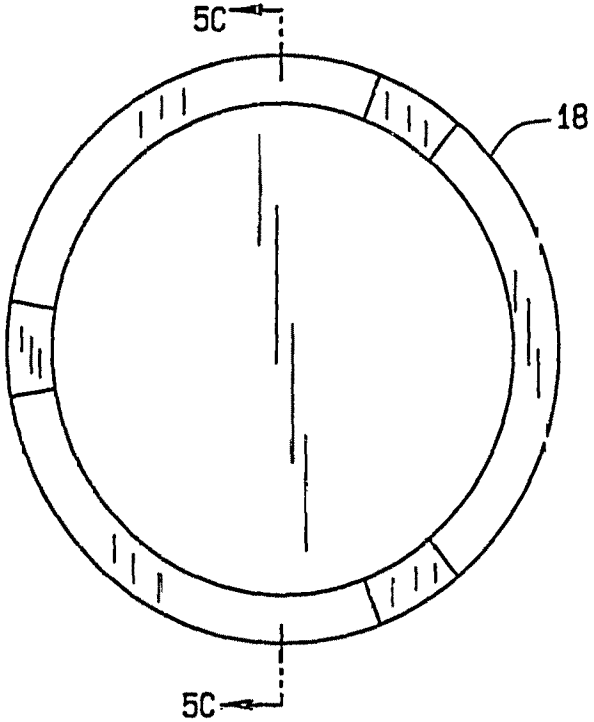

FIGS. 5A-5C show the various types of compact clamping means that are used for holding the ends of the bellows sealed in place, as previously shown and described in FIGS. 1 and 2.

Figure 9:
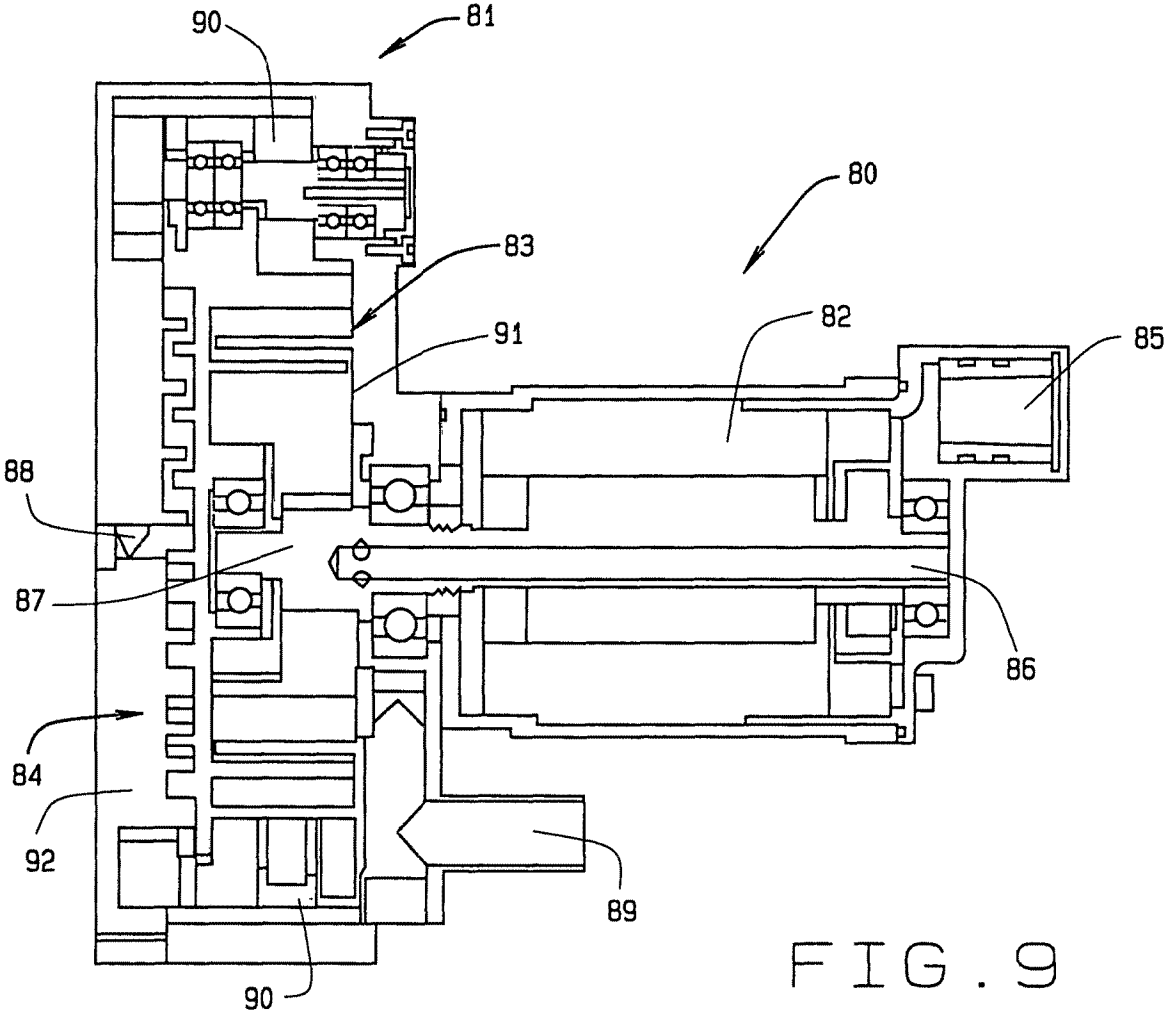
FIG. 9 shows a cross section of a two stage pump or compressor of this invention.

In referring to FIG. 9, this shows a two stage orbital style scroll vacuum pump, but it may also be a pump, compressor, or expander. This design has first and second stages in series, but could have said stages in parallel, for generating ultra-high vacuums, pressures, and the like, as can be understood. This structure results in a very compact unit, for this design, and therefore may be made to much lessor dimensions. As noted, the pump 80 includes its structured orbital pump or compressor 81, rendered operative from its motor 82, and its first stage orbital type structures is noted at 83, while the second stage is defined at 84. The gas to be evacuated or pressurized enters the inlet 85 is conveyed past the motor 82 and its crank shaft 86 into the plenum 87 for processing by the first stage of the device. The processed air then passes to the second stage, for further pressuring or evacuation, or expansion, and is discharged through the outlet 88. An alternative inlet 89 may be provided for entering gas directly into the first stage, as can be noted. There are a series of idler shafts 90 that are located within the structure of the device and positioned so that the axial forces can be counteractive and for maintaining the axial positioning of the orbiting scrolls of the stages, for obtaining that phased relationship between the various scrolls. The covers 91 and 92 form the housing and are provided to seal the various scrolls, in their operations, within the said first and second stages, and the orbiting scrolls are rendered operative by the identified motor 82, as stated.

As reviewed throughout this discussion, while the description generally is made for a vacuum pump, formed of the designs of the structure as shown and identified herein, the units can just as easily be made into a compressor; and thus the terms "vacuum pump" and "compressor" are used interchangeably, to mean either type of multi-stage pumps or compressors. Essentially, it is the combination of the various scrolls either in parallel, or in series, or a combination of such, that form the multi-stage scroll devices of this invention.

Variations of modifications to the subject matter of this invention may occur to those skilled in the art upon review of the summary of the invention as provided herein, and upon undertaking a study of the description of its preferred embodiments in view of the drawings. Such variations, if within the spirit of this invention, are intended to be encompassed within the scope of any claims to patent protection issuing hereon. The description of the preferred embodiment, and its depiction in the drawings, are generally set forth for illustrative purposes only.

We claim:

1. A multi-stage vacuum pump and motor for producing a vacuum comprising:

a housing, said housing having first and second end caps provided thereon, at least one driven scroll plate provided therein, at least one spinning drive scroll plate provided within said housing, and intermeshing its scrolls with the scrolls on the at least one driven scroll plate, said housing first end cap and said at least one driven scroll plate having central passages provided therethrough for entrance of gas therein to be evacuated, a bellows interconnecting between the at least one driven scroll plate and the at least one spinning drive scroll plate and surrounding both of the least one driven scroll plate and the at least one spinning drive scroll plate to contain the processed gas therein, said second end cap having an integral extension thereon to mount said motor, a back motor bracket securing with said integral extension to secure said motor intermediate thereof, and said motor when operative turning a motor shaft, said motor shaft extending centrally into said at least one spinning drive scroll plate, said motor shaft having a central channel provided therethrough such that said at least one driven scroll plate provides for entrance of gas at the periphery of both of the at least one driven scroll plate and the at least one spinning drive scroll plate and induces the generation of a vacuum approximately centrally of said at least one spinning drive scroll plate and transmits the vacuum pressure through said motor shaft channel for use for operation of vacuum functioning of other instrumentation.

2. The multi-stage vacuum pump of claim 1, wherein said bellows transmits rotational motion from said at least one spinning drive scroll plate to said at least one driven scroll plate.

3. The multi-stage vacuum pump of claim 2, wherein said at least one driven scroll plate is bearing mounted for rotation within said first end cap.

4. The multi-stage vacuum pump of claim 2, wherein said scrolls of said at least one driven scroll plate incorporate tip seals to enhance the efficiency of generation of a vacuum during operations of said vacuum pump.

5. The multi-stage vacuum pump of claim 4, wherein tips of the scroll of said at least one driven scroll plate include slots, and the tip seals provided within said slots.

6. The multi-stage vacuum pump of claim 5, wherein said scroll slots and said tip seals of the scroll of the at least one driven scroll plate are approximately truncated in shape.

7. The multi-stage vacuum pump of claim 4, wherein the tip seals are of approximately truncated shape.

8. A multi-stage compressor and motor for producing a high pressure gas, comprising:

a housing, said housing having first and second end caps provided thereon, at least one driven scroll plate provided therein, at least one spinning drive scroll plate provided within said housing, and intermeshing its scrolls with the scrolls on the at least one driven scroll plate, said housing first end cap and said at least one driven scroll plate having central passages provided therethrough for entrance of gas therein to be compressed, a bellows intermating between the at least one driven scroll plate and the at least one spinning drive scroll plate and surrounding said both of the at least one driven scroll plate and the at least one spinning drive scroll plate to contain the processed gas therein, said second end cap having an integral extension thereon to mount said motor, a back motor bracket securing with said integral extension to secure said motor intermediate thereof, said motor when operative turning a motor shaft, said motor shaft extending centrally into said at least one spinning drive scroll plate, said motor shaft having a central channel provided therethrough, such that both of the at least one driven scroll plate and the at least one spinning drive scroll plate provide for entrance of gas at the periphery of both of the at least one driven scroll plate and the at least one spinning drive scroll plate and induce the generation of pressurized gas centrally of both of the at least one driven scroll plate and the at least one spinning drive scroll plate and transmits said pressurized gas through said motor shaft channel for use for operation of said pressurized gas for functioning of other instrumentation.

9. The multi-stage compressor of claim 8, wherein said bellows transmits rotation from at least one spinning said drive scroll plate to said at least one driven scroll plate.

10. The multi-stage compressor of claim 9, wherein said at least one driven scroll plate is bearing mounted for rotation in said first end cap.

11. The multi-stage compressor of claim 9, wherein said scrolls of said at least one driven scroll plate incorporate tip seals to enhance the efficiency of generation of pressurized gas during operations of said compressor.

12. The multi-stage compressor of claim 11, wherein tips of the scroll of said at least one driven scroll include slots, and said tip seals provided within said slots.

13. The multi-stage compressor of claim 12, wherein said scroll slots and said tip seals are of truncated shape.

14. A multi-stage compressor of claim 11, wherein said tip seals are of truncated shape.

15. The multi-stage compressor of claim 8, further including clamps securing the ends of the bellows to the at least one driven scroll plate and the at least one spinning drive scroll plate.

16. The multi-stage compressor of claim 15, further including o-rings cooperating with said clamps to seal in the generated compressed gas within the compressor during its functioning.

17. The multi-stage compressor of claim 8 wherein said at least one driven scroll plate having an alignment aperture provided therein, said at least one spinning drive scroll plate having an alignment aperture provided therein, and a phase alignment pin provided for insertion within said plate alignment apertures for establishing the phase relationship between the at least one spinning drive scroll and the at least one driven scroll to assure the proper phased alignment between the spinning drive scroll and the driven scroll to attain proper operation of the compressor during its usage.

18. The multi-stage compressor of claim 17, wherein said alignment pin is removed after said scrolls have been fixed relative to each other before operations of the said compressor.

19. A multi-stage vacuum pump and motor for producing a vacuum, comprising:

a first housing, first and second end caps for said first housing, a driven scroll plate provided within said first housing, a spinning drive scroll plate provided within said first housing and intermeshing its scrolls with the scrolls on the driven scroll plate, said first housing first end cap and said driven scroll plate having central passages provided therethrough for entrance of gas therein to be evacuated, a bellows interconnecting between said driven scroll plate and the spinning drive scroll plate and surrounding both of the at least one driven scroll plate and the at least one spinning drive scroll plate to contain the processed gas therein, said second end cap having an integral extension thereon to mount said motor, a back motor bracket securing with said second end cap extension to secure said motor at one end thereof, a second housing, said second housing having first and second end caps provided thereon, a further driven scroll plate provided within said second housing, and another spinning drive scroll plate provided within said second housing and intermeshing its scrolls with the scrolls on the further driven scroll plate, said second housing first end cap and said further driven scroll plate having central passages provided therethrough for entrance of gas therein to be further evacuated, a second bellows interconnecting between the further driven scroll plate and the another spinning drive scroll plate of said second housing and surrounding both of the further driven scroll plate and the another spinning drive scroll plate to contain the processed gas therein, said first end cap of the second housing having a second integral extension thereon to mount the other end of said motor, a second back motor bracket securing with said second integral extension to secure said motor between said first and second housings thereof, said motor when operative turning a motor shaft, said motor shaft extending centrally between said spinning drive scroll plates of the first and said another spinning drive scroll of second housings, said motor shaft having a central channel provided therethrough to pass the evacuated gas from the first housing to the second housing and said another spinning drive scroll plate, so that the entrance of gas at the periphery of both of the further driven scroll plate and the another spinning drive scroll plate induces the generation of a vacuum also within both of the further driven scroll plate and the another spinning drive scroll plate of the second housing and transmits the vacuum pressure from said first housing, through said motor shaft channel, for further processing by both of the further driven scroll plate and the another spinning drive scroll plate in the second housing, and for discharge of the vacuumed gas for functioning of other instrumentation through the usage of this multi-stage vacuum pump.

20. The multi-stage vacuum pump of claim 19, and wherein said further driven scroll plate in the second housing has a central passageway provided therethrough for discharge of the vacuumed gas out of the second housing during usage.

21. The multi-stage vacuum pump of claim 20, and wherein said bellows of the first and second housings transmits rotation from the spinning drive scroll plate of each of the first and the second housing to its associated driven scroll plate during operations of the said vacuum pump.

22. The multistage vacuum pump of claim 19 wherein said at least one driven scroll plate having an alignment aperture provided therein, said at least one spinning drive scroll plate having an alignment aperture provided therein, and a phase alignment pin provided for insertion within said plate alignment apertures for establishing the phase relationship between the at least one spinning drive scroll and the at least one driven scroll to assure the proper phased alignment between the spinning drive scroll and the driven scroll to obtain proper operation of the vacuum pump during its usage.

23. The multi-stage vacuum pump of claim 22, wherein said alignment pin is removed after the at least one spinning drive scroll and the at least one driven scroll have been fixed relative to each other before operations of the said vacuum pump.

* * * * *